United States Patent [19]

Lattion

[11] Patent Number: 4,598,881

[45] Date of Patent: Jul. 8, 1986

[54] BOBBIN INSERTING DEVICE

[75] Inventor: Andrè Lattion, Seuzach, Switzerland

[73] Assignee: Rieter Machine Works, Ltd., Winterthur, Switzerland

[21] Appl. No.: 611,710

[22] Filed: May 18, 1984

[30] Foreign Application Priority Data

May 20, 1983 [GB] United Kingdom ..... 8313994

[51] Int. Cl.[4] ..... B65H 54/26; B65H 67/04

[52] U.S. Cl. ..... 242/35.5 A; 242/18 DD

[58] Field of Search ..... 242/35.5 A, 35.5 R, 242/35.6 R, 18 DD, 18 PW; 57/279, 268, 269, 270

[56] References Cited

U.S. PATENT DOCUMENTS

| | | | |
|---|---|---|---|
| 3,791,126 | 2/1974 | Kose et al. | 242/35.5 A |
| 3,971,520 | 7/1976 | Shimai | 242/35.5 A |
| 3,991,950 | 11/1976 | Tashiro et al. | 242/18 DD |
| 4,102,506 | 7/1978 | Raasch et al. | 242/18 DD |
| 4,140,286 | 2/1979 | Lattion | 242/18 DD |
| 4,154,411 | 5/1979 | Kamp et al. | 242/35.5 R |
| 4,352,466 | 10/1982 | Baumges et al. | 242/35.5 A X |
| 4,399,951 | 8/1983 | Preuhs | 242/35.5 A X |

FOREIGN PATENT DOCUMENTS

| | | | |
|---|---|---|---|
| 2217295 | 12/1972 | Fed. Rep. of Germany | 242/18 DD |
| 2218520 | 1/1973 | Fed. Rep. of Germany | 242/18 DD |
| 2828868 | 1/1979 | Fed. Rep. of Germany | 242/35.5 A |
| 2816418 | 10/1979 | Fed. Rep. of Germany | 242/35.5 A |
| 815649 | 7/1959 | United Kingdom | 242/18 DD |
| 2039552 | 8/1980 | United Kingdom | 242/35.5 A |

*Primary Examiner*—Stanley N. Gilreath

*Attorney, Agent, or Firm*—Kenyon & Kenyon

[57] ABSTRACT

The yarn handling machine employs a bobbin holder which is able to receive an individual bobbin of varying diameter from a magazine while positioning the axis of the received bobbin at a common collection position. A bobbin gripper engages the positioned bobbin at the collection position and moves along a common bobbin insertion path to a transfer location whereat the bobbin is transferred into a cradle mechanism. Both the bobbin gripper and cradle mechanism are movable together to position the bobbin at a winding position. The cradle mechanism can be reopened at the yarn winding position to permit clamping of a fresh yarn while the bobbin is held by the gripper.

11 Claims, 14 Drawing Figures

Figure 3:
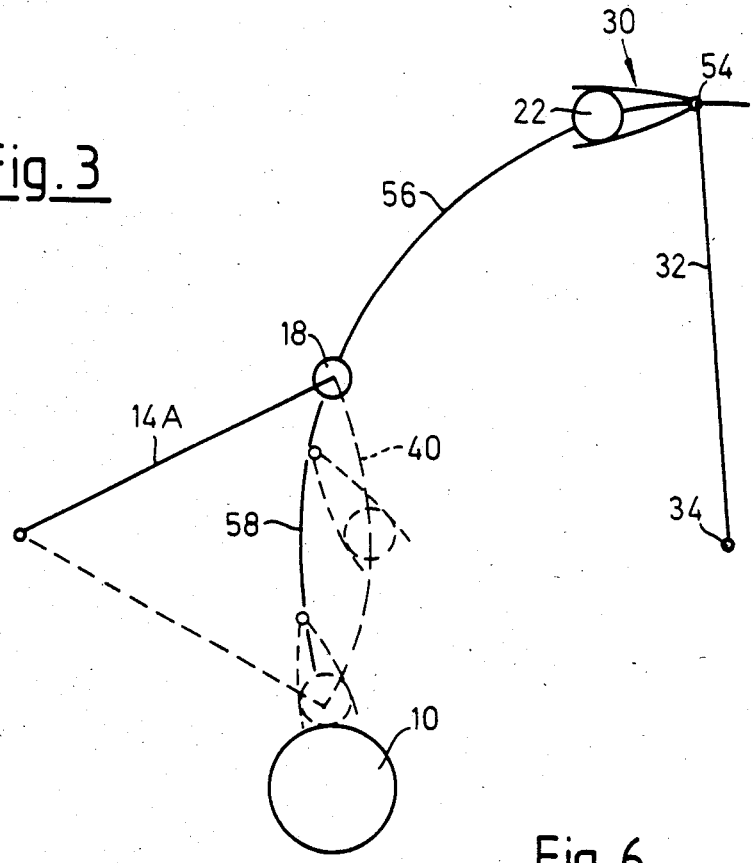

Fig.1
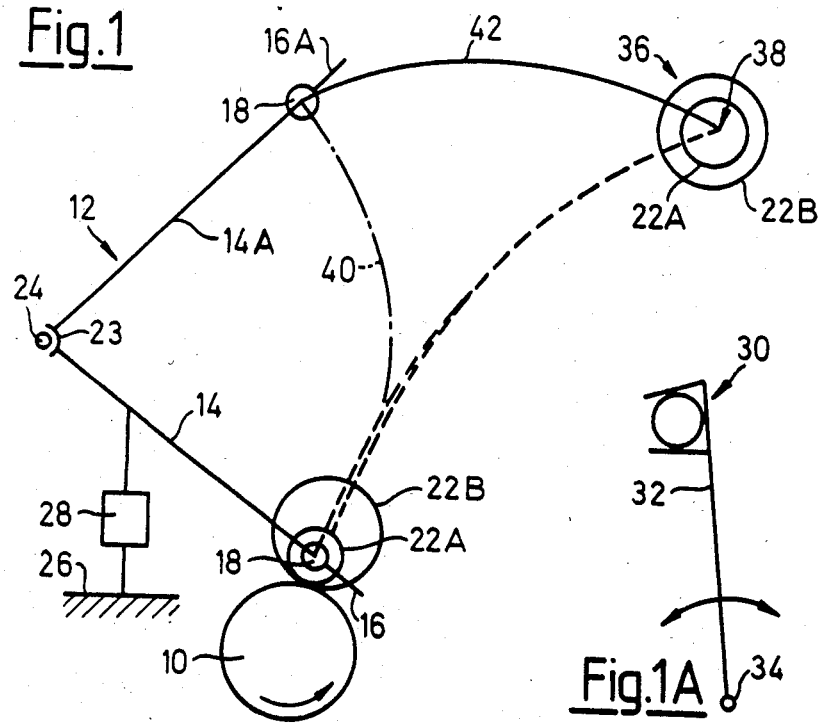
Fig.1A
Fig.2
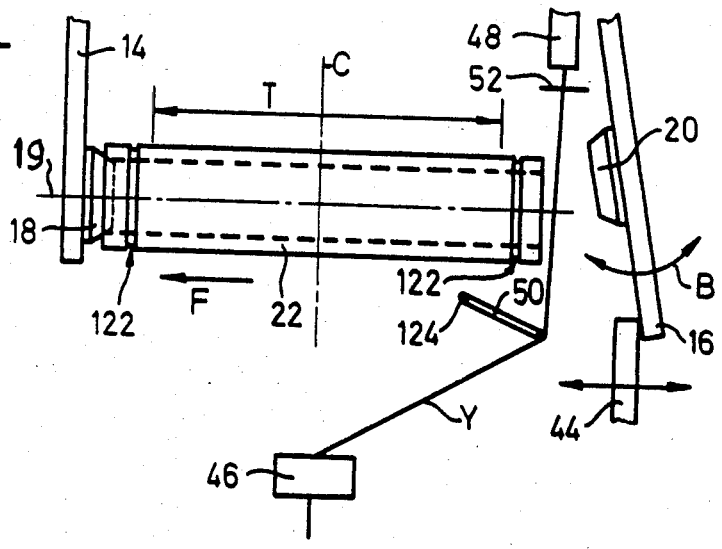

Fig. 9.
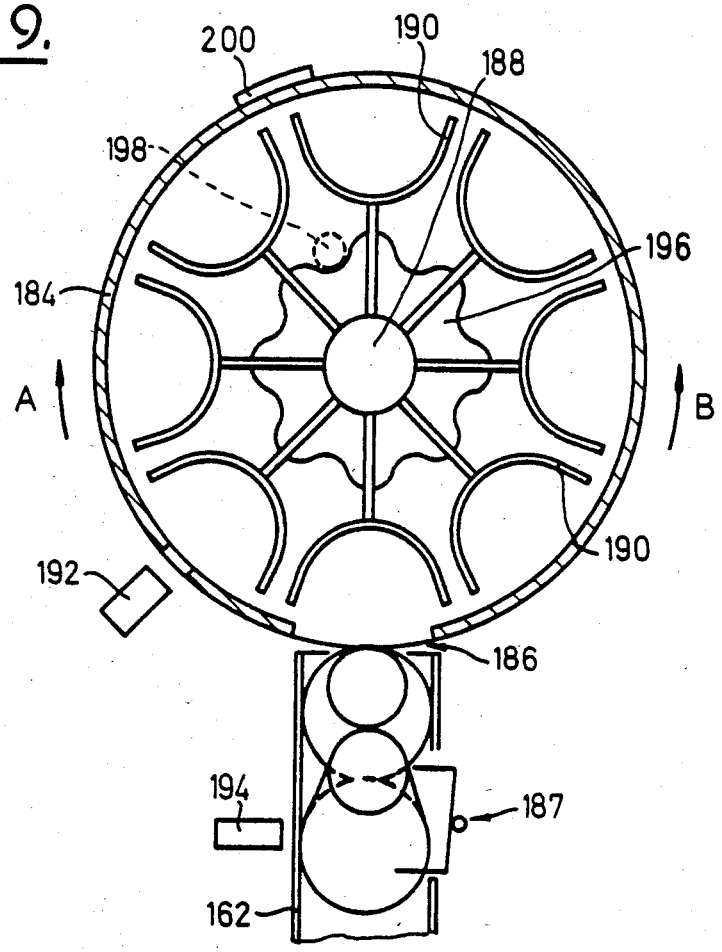
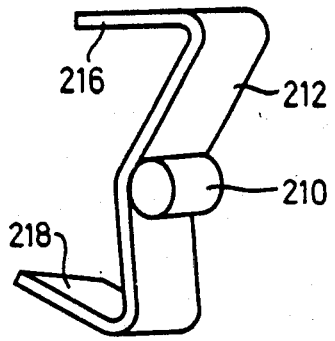
Fig. 10.

BOBBIN INSERTING DEVICE

The present invention relates to improvements in yarn handling machines of the type having a plurality of operating stations each including a yarn wind-up apparatus comprising a friction drive roll and a cradle means for holding a bobbin tube/yarn package in contact with the friction drive roll during formation of a yarn package on the bobbin tube. Such machines include, in particular but not exclusively, rotor spinning machines; other examples include automatic rewinders for rewinding cops into cross-wound packages and false twist texturising machines. By way of example only, examples of the type of wind-up mechanism involved can be seen from the following patent specifications-German No. 2649156, U.S. Pat. No. 3,356,306 and GB No. 1399891.

When starting winding at any one operating station, it is necessary to insert a bobbin tube into the cradle device and to connect a yarn to the inserted tube. It is now well known to perform such operations by means of a travelling service tender which is movable to and fro past the operating stations and can stop in alignment with any one of them to perform the required operations thereon.

It is also well known to provide such a tender with a bobbin inserting device in form of a pivotable arm provided at its free end with a bobbin gripper. Furthermore, the bobbin grippers have been provided with rollers to engage the bobbin tube so as to permit rotation of the tube while it is held by the gripper. This has been done for varying purposes; e.g. in U.S. specification No. 3,948,452, in order to enable acceleration of the incoming bobbin tube to the full winding speed; in German published patent application (Offenlegungsschrift) No. 2503545, in order to enable the start of winding of a new package to be effected practically simultaneously with the ejection of a full package and in German published patent application (Offenlegungsschrift) No. 3039857, to enable rotation of the incoming bobbin tube at a speed higher than the normal winding speed during formation of a thread reserve.

It has also been proposed in Swiss patent No. 625187 and U.S. Pat. No. 4,352,466 that the incoming bobbin tube should be transferred from the bobbin inserting device to the cradle mechanism at an intermediate position on the arc of swing of the cradle mechanism such that the bobbin tube is not then in contact with the friction drive roll. This enables temporary insertion of transmission rollers between the friction drive roll and the incoming bobbin tube, so that the tube can be rotated at a speed lower than the normal winding speed during formation of a thread reserve. The final stage of movement between the intermediate position and the normal winding position is effected only by movement of the cradle mechanism, the bobbin inserting device being withdrawn from contact with the bobbin tube.

VARYING BOBBIN DIAMETER

The prior specifications do not make any specific allowance for varying bobbin diameters. In practice, however, the bobbin diameter can vary substantially depending upon the requirements of the end-user of the yarn handling machine. For example, depending upon the requirements of the end-user, the diameters of bobbins used on current open-end spinning machines can vary between approximately 60 mm and 105 mm.

In order to deal with this problem, the invention provides a bobbin inserting device having a bobbin gripper which is movable along a fixed path of movement and which is associated with a bobbin holder adapted to present a bobbin to the gripper. The bobbin holder may be adaptable to locate bobbins of varying diameters relative to the fixed path of movement of the gripper. The fixed path of movement may be capable of arrangement relative to an operating station of a yarn-handling machine to define a transfer location at which a bobbin carried by the gripper is inserted into a cradle mechanism at that station. The transfer location may be such that, at least for smaller diameter bobbins, an inserted bobbin is moved by the cradle mechanism from the transfer position to a winding position in which the bobbin contacts the friction drive roll of the relevant operating station.

YARN CLAMPING

Furthermore, in those prior specifications describing systems in which a bobbin is inserted into a cradle mechanism at a transfer location and is moved by the cradle mechanism from the transfer location to a winding position in contact with a friction roll (i.e. in Swiss specifications No. 625187 and U.S. specification No. 4,352,466), the yarn must be secured to the bobbin while the latter is at the transfer location to enable subsequent winding of a thread reserve prior to movement of the inserted bobbin to the winding position. Accordingly, an undesirable yarn path length variation is produced during the final movement of the bobbin from the transfer location to the winding position.

The present bobbin inserting device may comprise a carrier member carrying the bobbin gripper and movable to move the bobbin gripper along its bobbin insertion path. The carrier member may be further movable to move the bobbin gripper to hold an inserted bobbin in the winding position to which it has been moved by the cradle mechanism. For this purpose, the bobbin gripper may be adjustably mounted on the carrier member. The cradle mechanism may then be releasable after the bobbin is located in the winding position to enable clamping of the yarn between the cradle mechanism and the inserted bobbin. Conveniently, the gripper is adapted to urge the bobbin against a part of the cradle mechanism after the release of the latter; this feature enables continued axial location of the bobbin and simultaneous angular location of the cradle.

CONICAL PACKAGES

Some of the above mentioned prior specifications show service tenders suitable for use with cylindrical yarn packages, and others show service tenders suitable for use with conical yarn packages. None of them shows a tender suitable for use selectively with either cylindrical or conical packages.

Figure 5:
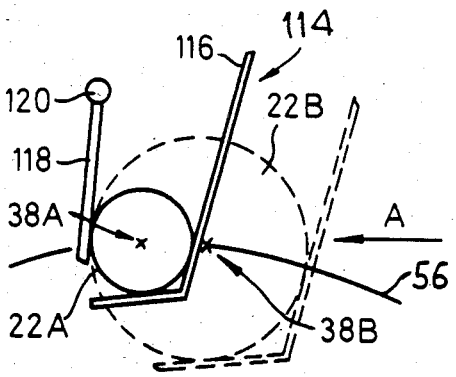
Figure 6:
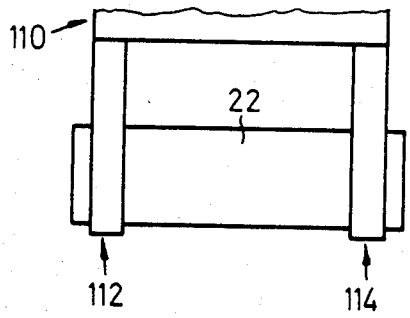
Figures 4, 4A, 4B:
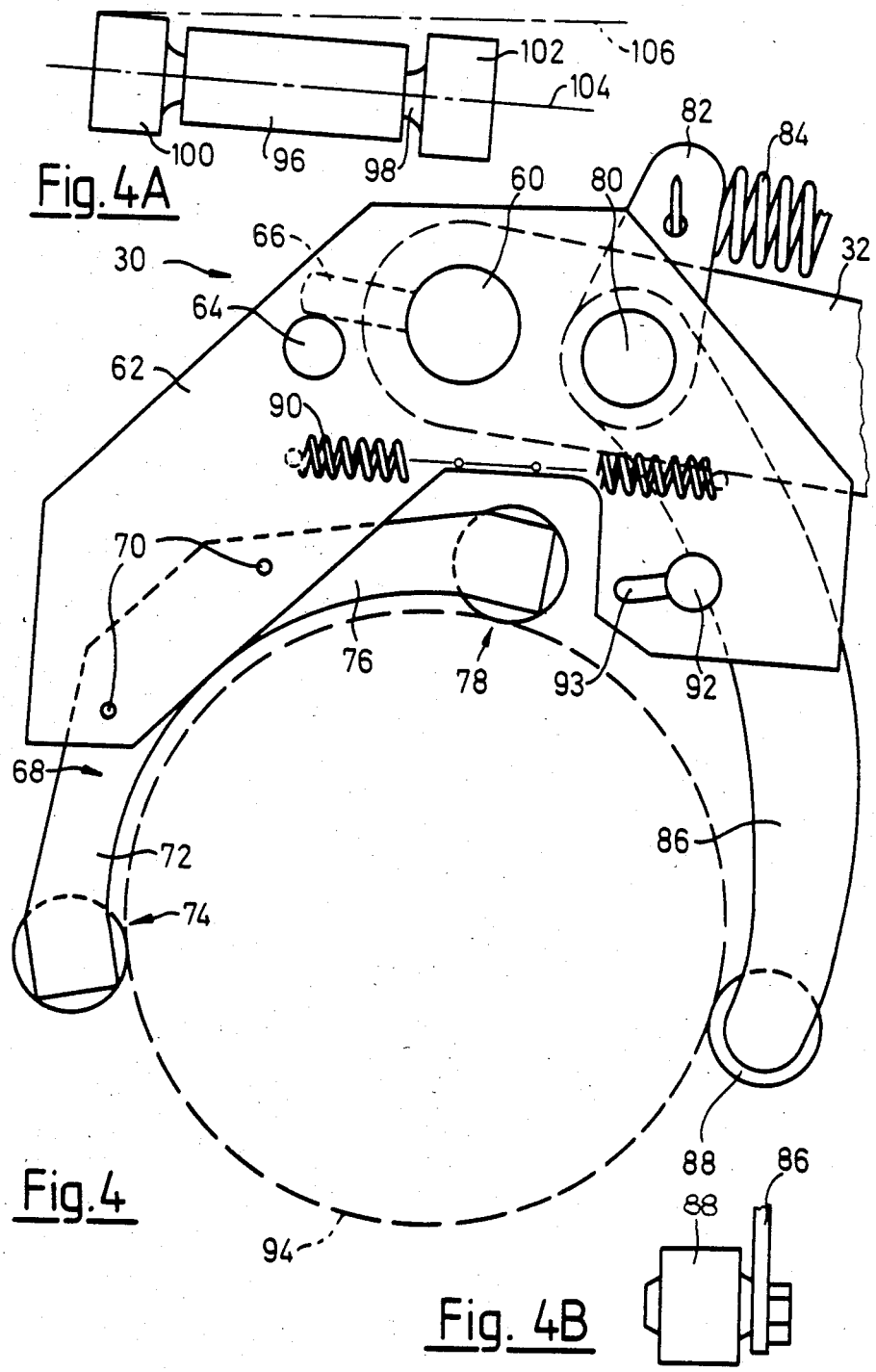
Figure 7:
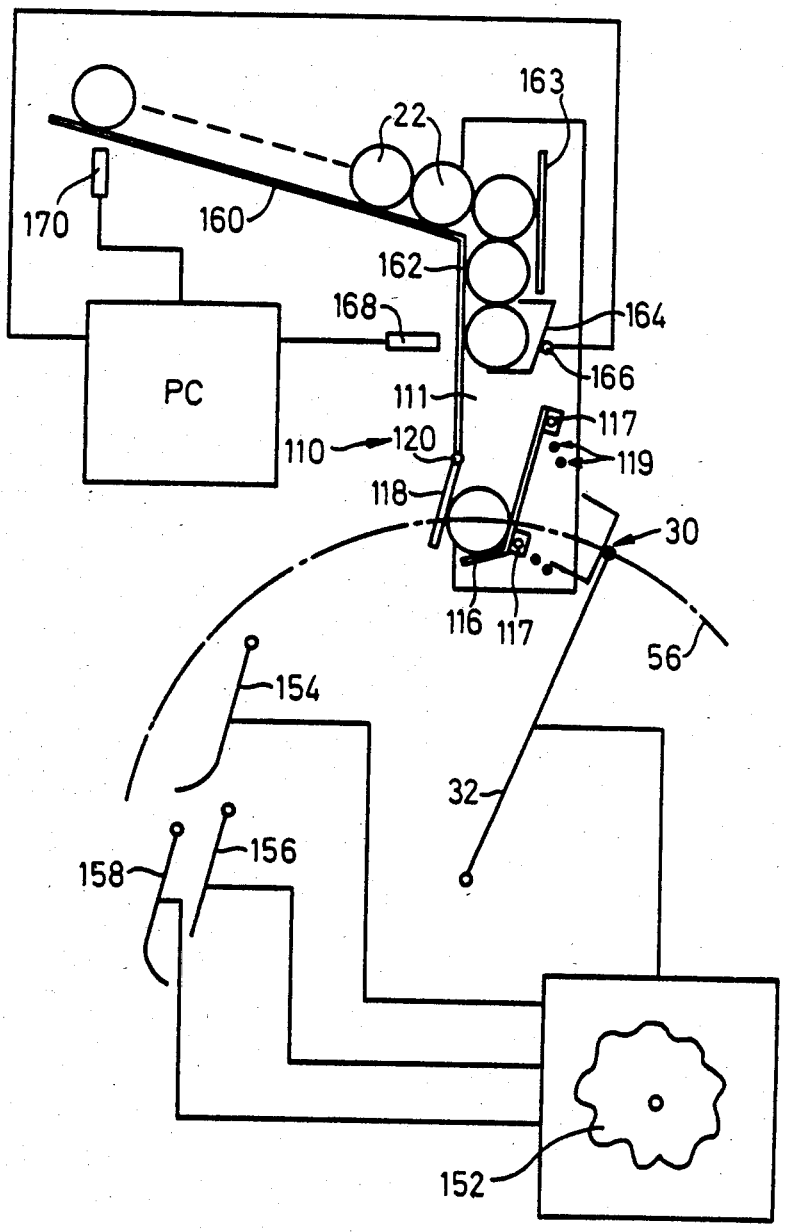
Figure 8:
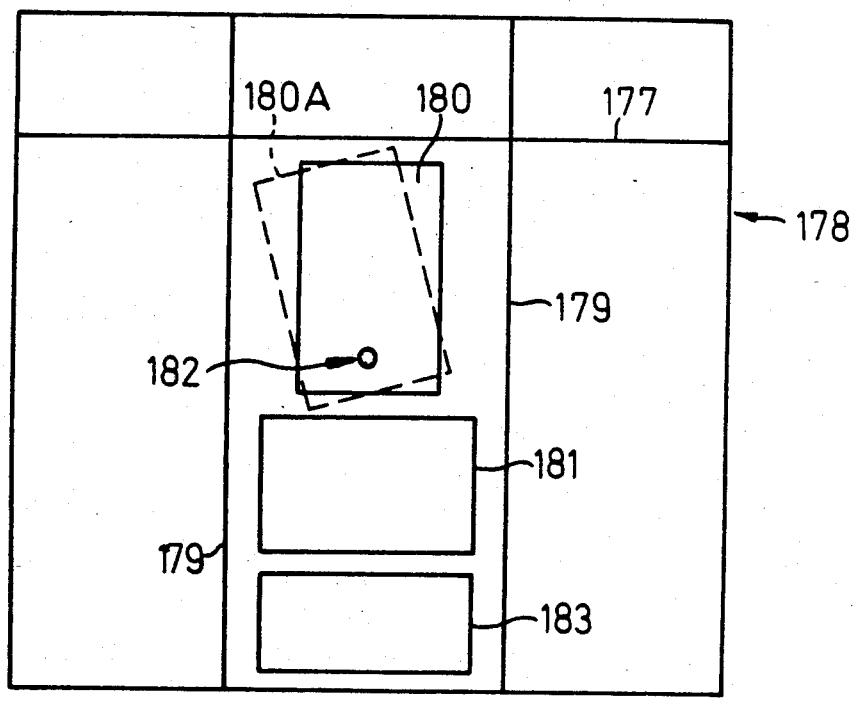
Figure 11:
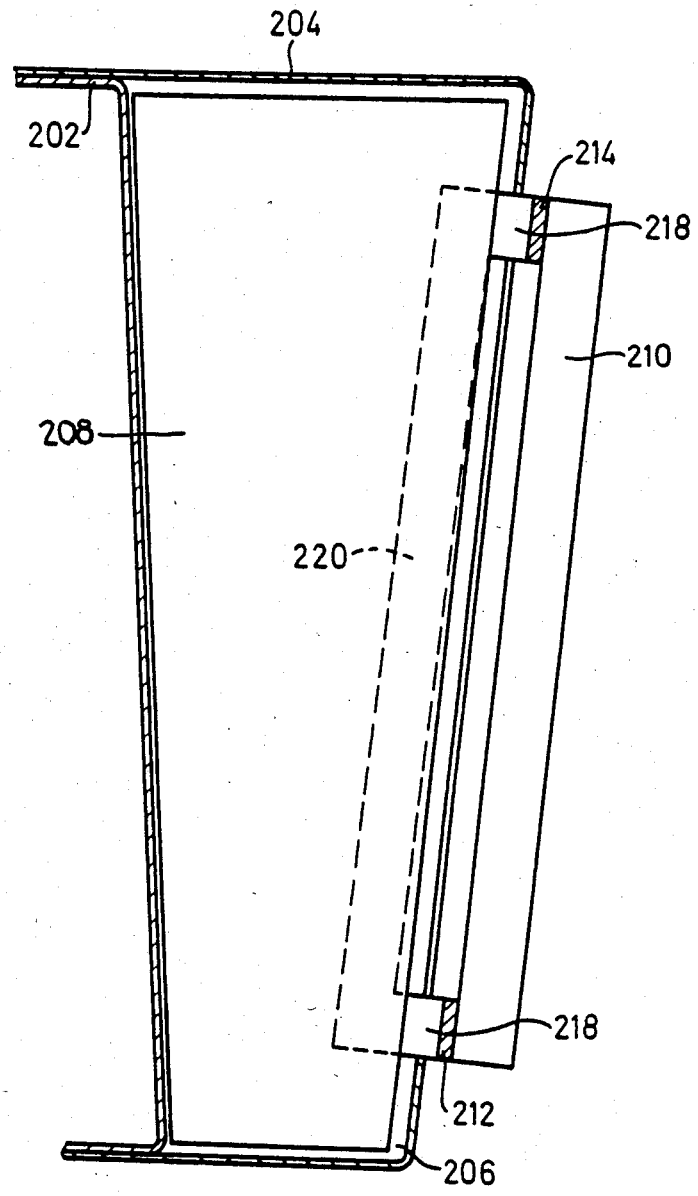

Further details of the invention will now be given by reference to the accompanying diagrammatic drawings, in which FIG. 1 is a diagrammatic representation of a cradle mechanism and a bobbin inserting system showing the effect of varying bobbin diameter, FIG. 1A diagrammatically illustrates a pivotally mounted bobbin gripper used in accordance with the invention, FIG. 2 is a more detailed (but still diagrammatic) view of part of a cradle mechanism in association with a thread reserve forming device, FIG. 3 is a diagram illustrating a second aspect of a bobbin inserting system, FIG. 4 is a side-view of a bobbin gripper suitable for handling varying bobbin diameters, FIG. 4A illustrates a roller assembly used in the gripper of FIG. 4 in accordance with the invention;

FIG. 4B illustrates a side view of a roller employed in the gripper of FIG. 4,

FIG. 5 is a side-view of a bobbin holder suitable for handling varying bobbin diameters, FIG. 6 is a view in the direction of the arrow A in FIG. 5, FIG. 7 is a diagram for use in explanation of a system for terminating winding at a selected station, FIG. 8 shows a diagrammatic elevation of a service tender adapted to service a yarn-handling machine having a system in accordance with the invention, FIG. 9 is a section through a bobbin magazine suitable for conical bobbins, FIG. 10 illustrates a perspective view of a gate mechanism of the magazine of FIG. 9, and FIG. 11 illustrates a cross-sectional view of the feed chute of the magnazine of FIG. 9.

GENERAL

FIG. 1 shows in diagrammatic side elevation a friction drive roll 10 and a bobbin cradle mechanism generally indicated by the numeral 12. The cradle mechanism comprises a pair of arms 14, 16 which are aligned with one another as viewed in FIG. 1 so that only the nearer arm 14 is fully visible in that figure. Arm 16 is slightly longer than arm 14 so that its end portion can be seen in FIG. 1. Each arm carries a respective centering plate 18, 20 (better seen in FIG. 2) which in use carry between them a cylindrical bobbin tube 22.

Arms 14, 16 are carried by a carrier 23 (FIG. 1) which is pivotable about a bearing element 24 mounted in the machine structure. Arm 14 is fixed to the carrier, but arm 16 is pivotally mounted thereon for movement towards and away from the arm 14 as indicated by the double-headed arrow B in FIG. 2. Arm 16 has a normal position approximately parallel to arm 14 such that bobbin tube 22 is clamped between the plates 18 and 20. However, when arm 16 is pivoted away from arm 14 as shown in FIG. 2, a space is made for release of a yarn package formed on the bobbin tube 22 and/or insertion of a fresh bobbin tube between the centering plates.

Cradle mechanism 12 further comprises a cradle loading device 28 (FIG. 1). Device 28 is fixed at one end to the machine structure 26 and at the other end to the cradle comprising carrier 23 and arms 14,16. The loading device includes a biasing means (usually a spring-weighted device) which normally tends to draw the arms 14, 16 downwardly as viewed in FIG. 1 into a winding position in which a bobbin tube 22 carried by the arms engages the friction roll 10. Roll 10 is driven into rotation about its own longitudinal axis as indicated by the arrow in FIG. 1, and the plates 18, 20 are rotatable about axis 19 on the arms 14, 16 so that the bobbin tube 22 is rotated by frictional engagement with the roll 10. When a yarn is secured to the bobbin tube, therefore, it will begin to wind on the tube and a suitable traverse guide means (not shown) is provided to enable formation of a cross-wound package is a well-known manner. The arms 14, 16 can, however, be swung upwardly on the bearing element 24 to an uppermost position 14A, 16A in FIG. 1 and the loading device 28 has an over-centre system such that the weighting means is ineffective to draw the arms downwardly out of this uppermost position.

The arrangement thus far described is very well-known and widely used on several different textile machines, e.g. rotor spinning machines, automatic rewinding machines and false twist texturising machines. By way of example only, the arrangement as applied to open-end spinning machines can be seen in British patent No. 1349425.

In a practical yarn handling machine (whether a spinning machine, winding machine, texturising machine or any other type) there are normally a large number of operating stations arranged side by side along an elongated frame of the machine. In current machine design, up to 100 operating stations per machine side are common. Each operating station has its own cradle mechanism 12; the stations may also have respective friction drive rolls 10, or there may be a common roller extending for the full length of one machine side. It is now common practice to effect both package ejection and bobbin insertion automatically in such a machine so to reduce the manual attendance required. The devices required to perform these operations automatically may be provided at the individual spinning stations, but for economic reasons it is preferred to provide a service tender which is provided with one set of ejection/insertion devices and which is movable longitudinally of the machine past the stations. Means is provided to locate the tender in alignment with any selected station in order to enable performance of ejection/insertion operations thereon. In the following description, the use of a service tender will be assumed, but it will be apparent that the principles described could also be applied to multiple ejection/insertion devices.

BOBBIN INSERTION

Bobbin insertion is commonly effected by means of a bobbin gripper 30 (FIG. 1A) mounted at the end of an arm 32 which is pivotable about a pivot mounting 34 in the service tender. The gripper collects a bobbin from a bobbin holder (not shown) in an upper portion of its swinging movement about the mounting 34, and then moves the bobbin to a position at which the bobbin can be transferred to the cradle mechanism 12. The bobbin holder may be on the service tender or on the machine, but in the latter case one bobbin holder per operating station is required.

In many yarn handling machines, it is common practice to design the machine to accept bobbins of radically different external diameter. This provides substantially increased flexibility for the machine user in providing varying packages for varying end-user requirements. By way of example only, bobbin diameters used by spinning mills on rotor spinning machines may vary between approximately 60 and 105 mm. Assume now that a "bobbin collection position" 36 (FIG. 1) is defined at which the gripper 30 collects a bobbin presented to it by a suitable bobbin holder. Assume further that the holder is designed to hold all bobbin axes 38 at a predetermined location in the bobbin collection position, regardless of varying external diameters 22A and 22B respectively. It will be seen, however, that when these bobbins are in their respective winding positions in contact with the drive roll 10, their axes are spaced along the arc 40 swept out by the axis 19 during pivotal movement of the arm 14, 16. Accordingly, if the bobbin insertion device shown in FIG. 1A attempts to bring bobbins of varying diameters to their respective winding positions, for insertion into the cradle mechanism at those winding positions, then the movement mechanism for the bobbin insertion device requires adaptation in dependence upon the bobbin diameter and such system adaptation is highly undesirable since it involves complex movement setting operations. Further, the tender must control the cradle position.

The above disadvantages can be avoided by a system in which the bobbin insertion device does not insert bobbins into the cradle mechanism at the winding position, but at a "transfer location" which is spaced from the winding position. In the preferred embodiment shown in FIG. 1, this transfer location is defined by the uppermost position of the cradle. This uppermost position of the cradle (and, correspondingly, the transfer location) is the same for all bobbin diameters. It is not essential to use the uppermost position of the cradle to define the transfer location, which could be shifted along the arc 40 towards the friction roller 10 as far as the winding position of the largest diameter bobbin for which the machine is designed. However, the uppermost position of the cradle is preferred because it is a closely defined position in which the cradle is held in a stable condition without direct intervention of the service tender.

As indicated by the curve 42 ("bobbin insertion path") in FIG. 1, the path of movement of the bobbins between the collection position and the transfer location is the same regardless of bobbin diameter. Accordingly, while it is necessary to adapt the bobbin holder and the bobbin gripper to varying bobbin diameters, it is no longer necessary to adapt the movement defining system for the bobbin insertion device. The illustrated examples assume a pivotal movement for the bobbin insertion device, defining curved bobbin insertion paths. It will be apparent, however, that the principles are the same for a reciprocatory bobbin insertion device defining straight bobbin insertion paths.

In order to enable insertion of a bobbin into the cradle at the transfer location, the cradle must be "opened" i.e. arm 16 must be pivoted away from its normal, parallel di position relative to arm 14 to create space, so that the gripper 30 can bring the bobbin to a position in which the bobbin is substantially coaxial, with the axis 19 (FIG. 2). The cradle must then be "closed", i.e. arm 16 must be returned to its normal disposition so that the bobbin is clamped between the plates 18, 20. These movements of the arm 16 can be effected by a lever (not shown in FIG. 1) mounted in the service tender and operable by means to be described later. Such devices are now well-known in the art. An inserted bobbin is moved to its respective winding position by downward movement of the cradle from its uppermost position as viewed in FIG. 1. This movement can also be effected by a suitable lever provided on and operated by the tender. The bobbin insertion function of the gripper 30 is therefore completed when the bobbin is transferred to the cradle. However, for reasons which will now be explained, it may be desired to have the gripper hold the bobbin also in its winding position.

YARN CLAMPING

Consider now the diagram of FIG. 2 in further detail. The bobbin 22 is assumed to be already in its winding position in contact with the friction roller 10. However, the cradle is illustrated in its open or "release" condition with the arm 16 pivoted away from its normal disposition relative to the arm 14. Again, this is effected by a lever diagrammatically indicated at 44 in FIG. 2 mounted on and operated by the service tender. This re-opening of the cradle with the bobbin in the winding position enables extension of a yarn Y through the gap between the righthand end of bobbin 22 (as seen in FIG. 2) and the plate 20 on arm 16. If arm 16 is now returned to its normal disposition, this closing of the cradle will clamp the yarn Y between the bobbin end and the plate 20, thereby effectively securing the yarn to the bobbin for winding of a package thereon. Such clamping systems are well-known in the art.

Conveniently, the gripper 30 is used to hold the bobbin in the winding position during opening of the cradle in the course of the clamping operation. Although not illustrated in FIG. 2, the gripper 30 remains in gripping contact with bobbin 22 and urges it towards the left as viewed in that figure into continued contact with the plate 18. The clamping end of the bobbin (the righthand end as viewed in FIG. 2) is therefore accurately located during the clamping operation. A gripper design suitable for this purpose will be described in further detail later.

The yarn Y is commonly fed to the wind-up system from a guide system indicated generally by the numeral 46 in FIG. 2. When the yarn is secured to the rotating bobbin 22, the resulting yarn tension tends to draw the yarn into the shortest yarn path between the guide system 46 and the package forming on the bobbin 22. Normally, and in accordance with the assumption represented in FIG. 2, the shortest yarn path lies on the centre line C at the mid-length of the bobbin 22.

For purposes of securing the yarn to the bobbin 22 in order to start winding of a package, the yarn end is taken up by a yarn manipulating device 48. The form of this device will depend substantially upon the type of machine with which it is to be used. In a machine in which yarn is being forwarded towards the wind-up system (e.g. a spinning machine), the manipulating device 48 should also be a take-up device such as a suction pistol. Where yarn forwarding is dependent upon the wind-up itself, the manipulating device does not have to be a take-up. In any event, the manipulating device 48 is provided on and moved by the service tender.

Device 48 takes the yarn from the guide system 46 and extends it through the gap created by opening of the cradle between the bobbin 22 and the plate 20. The length of yarn which is to be clamped to the bobbin end should extend approximately at right angles to the axis 19. In order to ensure this, the yarn is acted on by auxiliary guide 50 which will be described in further detail below and which is also carried by the tender. As soon as the yarn is clamped to the bobbin by closing of the cradle, the length of yarn extending between the bobbin and device 48 is drawn by rotation of the bobbin against a knife edge indicated diagrammatically at 52. The knife is secured to the manipulating device 48 so that it remains spaced from the yarn until the latter is drawn into rotation. By this means, a short yarn tail is produced projecting from the clamping point, and the remainder of the yarn connected to device 48 is removed by the tender when it retracts the device 48 and knife 52.

MATCHING GRIPPER AND CRADLE MOVEMENTS

FIG. 3 shows the principle of matching of the gripper movement after bobbin insertion to the movement of the cradle between the transfer location and the bobbin winding position. The numerals used correspond with those used in description of FIG. 1, although the path of movement of the gripper 30 is different from that previously illustrated. There is an additional feature as compared with FIG. 1, namely that the gripper 30 is pivotally mounted on the arm 32 by a pivot mounting 54. Biasing means (not shown) hold the gripper 30 in a normal position relative to the arm 32, in which position the gripper 30 can collect a bobbin from the non-illustrated bobbin holder. Gripper 30 remains in this normal position during movement along the bobbin insertion path 56 from the collection location to the transfer location. Transfer of the bobbin from gripper 30 to the cradle is effected in the manner described above.

In FIG. 1, the bobbin inserting device would be retracted after insertion of a bobbin into the cradle. In FIG. 3, however, the anti-clockwise pivotal movement of the arm 32 continues even after bobbin insertion has been completed with the pivot mounting 54 moving along the extension 58 of the bobbin insertion path 56. The paths 56 and 58 which define a circular are can together be taken to define a "gripper path".

Simultaneously, the cradle is moved downwardly under the control of suitable levers on the tender to move the bobbin clamped therein from the transfer location to the winding position. The gripper path 56, 58 is arranged to intersect the arc 40 in the region of the bobbin winding positions. In this way, it is ensured that the gripper 30 is efficiently oriented relative to its arm 32 in order to hold the bobbin 22 in the winding position during the clamping operation as,described with reference to FIG. 2.

In addition, however, it is desired to maintain a hold of the gripper 30 on the bobbin 22 between the transfer location and the winding position. This avoids any necessity for the gripper to re-grip the bobbin after it has arrived at the winding position. Such continued hold of the gripper on the bobbin during movement of the gripper along the path section 58 is enabled by pivoting of the gripper 30 on its pivot mounting 54 against the effect of its biasing means. The movements of the arm 32 and of the cradle lowering control lever on the tender can be coordinated by a suitable programming system (to be described further hereinafter) so that the bobbin clamped in the cradle remains within the holding range of the gripper 30 throughout movement of the latter along the path section 58.

FIG. 4 shows a side elevation of one form of bobbin gripper 30 suitable for the system shown in principle in FIG. 3. As shown, the gripper 30 is carried by a carrier member in the form of a carrier arm 32 via a bearing shaft 60. The axis of the shaft 60 extends transversely to the length of the arm 32. The gripper 30 includes two plates 62 (only one of which can be seen in FIG. 4) which are spaced along shaft 60 on the same side of arm 32. Each plate is secured against movement axially of the shaft 60 but is free to rotate around the axis of the shaft. The plates are secured together by a cross piece 64 for joint rotation about the shaft axis. This rotation is limited in one direction, however, by abutment of the cross piece 64 with a pin 66 secured in shaft 60 and extending radially therefrom.

Each plate can be considered to have two "legs" extending away from shaft 60. The longer legs (to the left as viewed in FIG. 4) carry between them a yoke 68 which has a shallow U-shape. The bend of the U is secured by pins 70 to the plates 62. One arm 72 of the U forms an extension of the longer legs of the plates 62, and carries at its free end a roller assembly 74 which will be described further below. The other arm 76 of the U extends into the space between the legs of the plate 62 and a bobbin engaging element in the form of carries at its free end a roller assembly 78, similar to the assembly 74.

Mounted between the shorter legs of the plates 62 is a bearing pin 80. Pin 80 is fixed to the plates and carries a projecting lug 82 which is connected to one end of a tension spring 84, the other end of which (not seen) is connected to the arm 32. Spring 84, by its action on lug 82, tends to pivot plates 62 in a clockwise direction (as viewed in FIG. 4) about the bearing shaft 60, so that cross piece 64 is normally urged against abutment 66.

An arm 86 is mounted on pin 80 for pivotal movement about the axis of the pin. Arm 86 forms an extension of the shorter legs of plates 62, and a bobbin engaging element in the form of carries at its free end a single roller 88. A tension spring 90 is secured between plates 62 and arm 86 so as to draw the roller 88 towards the roller assemblies 74, 78. This movement is limited by a stop 92 extending between the shorter legs of the plates 62 and engaged by the arm 86. Stop 92 is adjustable in position along slot 93.

The dotted line 94 in FIG. 4 indicates the outline of a bobbin gripped by gripper 30. Arms 72 and 86 extend around more than half of the circumference 94 so that the roller 88 and the rollers of assembly 74 retain the bobbin in the gripper. The gripper can open to take up and release a bobbin by pivoting of arm 86 on pin 80 against the bias of spring 90. Penetration of the bobbin into the gripper is limited by the roller assemblies 78. In its approach movement to collect a bobbin, shaft 60 is moved along a rearward extension of the bobbin insertion path and the fully open "face" of the gripper is presented to the bobbin to be collected. At the collection stage, the gripper is held by spring 84 in its normal disposition, i.e. with cross piece 64 engaging abutment 66. The gripper maintains this normal disposition relative to arm 32 until it arrives in the transfer location.

During movement of the shaft 60 along the gripper path section 58 (FIG. 3), the path of the bobbin is determined by the cradle mechanism. However, the gripper maintains a hold on the bobbin throughout movement thereof from the transfer location to the winding position. In order to enable this, plates 62 pivot in an anti-clockwise direction as viewed in FIG. 4 around shaft 60, i.e. cross piece 64 pivots away from abutment 66, against the bias supplied by spring 84. The degree of pivot about shaft 60 reaches a maximum at the maximum spacing of the arc 40 and path 58, and the gripper 30 returns to its normal disposition, or a disposition very close thereto, as the bobbin reaches its winding position. The degree of pivot is exaggerated in FIG. 3 for ease of illustration of the principle.

The force F (FIG. 2) urging bobbin 22 towards plate 18 during the clamping operation is produced by the roller assemblies 74 and 78. As seen in FIG. 4A, each assembly comprises a bearing box 96 secured to the free end of the arm 72 or 76 and providing a bearing for a shaft 98 carrying a roller pair 100, 102. However, the axis 104 of the shaft 98 is skewed relative to the axis of the bobbin carried by the gripper. This is illustrated in FIG. 4A by means of a line 106 which can be assumed to lie parallel to the bobbin axis and hence parallel to the axis of shaft 60. The skew of the shaft axis 104 is sufficient to produce a net axial force on the bobbin when the latter is rotated in contact with the rollers 100, 102, the roller assemblies 74, 78 acting in unison to produce the required force F.

The gripper can be adapted to varying bobbin diameters by releasing the yoke 68 from the plates 62 and replacing it with an alternative yoke appropriate to the new bobbin diameter to be used. If required, the stop 92 can also be adjusted relative to the plates 62 in order to adapt to the new bobbin type. Instead of a replaceable yoke 68, arms 72, 76 could of course be separately mounted on the gripper body provided by the plates 62, these arms being releasably secured in positions appropriate to the bobbin type to be used.

BOBBIN HOLDER

FIGS. 5 and 6 show a bobbin holder suitable for presenting bobbins of varying diameter to a gripper such as that shown in FIG. 4. The holder comprises a main body 110 (FIG. 6, omitted from FIG. 5) having depending leg structures 112, 114, one of which is, illustrated in FIG. 5. The illustrated leg structure comprises an inverted L-member 116 and a retainer member 118 which is pivotally mounted to the body 110 at 120 and is resiliently biased (by means not shown) in an anticlockwise direction relative to FIG. 5 into a normal disposition indicated in that figure. The limbs of the L-member 116 are positioned relative to the retainer 118 in a manner dependent upon the external diameter of the bobbins to be used. In the full line position shown in FIG. 5, a bobbin 22A of relative small external diameter rests on the (substantially) horizontal limb of the L-member 116 and is retained between the vertical limb and the retainer 118 with the bobbin axis 38A lying on the bobbin insertion path 56. In order to present a bobbin 22B of larger diameter, L-member 116 is moved downwardly and away from retainer plate 118 to a position such that the bobbin 22B is retained with its axis 38B also on the bobbin insertion path 56. The system differs from that shown in FIG. 1 in that the bobbin holder does not define a unique position for the bobbin axis in the bobbin collection position, but this does not necessitate any adjustment of the gripper path.

As seen in FIG. 6, leg structures 112, 114 engage a presented bobbin 22 adjacent respective end portions thereof. Accordingly, the gripper 30 can be passed between the leg structures 112, 114, taking up the bobbin 22 in so doing. The spring bias urging retainers 118 into their normal positions must be stronger than the tension spring 90 of the gripper 30, so that the gripper first opens to receive the bobbin and the retainers then pivot away from their normal disposition (in a clockwise direction as viewed in FIG. 5) after engagement of the collected bobbin with the roller assembly 78. Feed of bobbins to the bobbin holder will be described later.

TERMINATION OF WINDING

As previously described, the bobbin insertion device is commonly associated with a package ejector. The description thus far has concentrated upon bobbin insertion and has assumed that a fresh bobbin is required each time a package is ejected. This is not always the case. Eventually, winding will be terminated at at least one station, e.g. for maintenance purposes or for a change of yarn type to be handled or for other reasons. At this time, it may be desired to carry out a package ejecting operation without inserting a fresh bobbin.

The full set of equipment for operating on a wind-up means during package ejection/bobbin insertion may comprise a cradle operating means, a package ejecting means, a bobbin inserting device, and a yarn manipulating device. Assuming that these elements are mounted on a service tender, they will be movable relative to the tender between operative and inoperative positions, adopting their inoperative positions during running of the tender to and fro past the operating stations. Movements of the various elements to their operating positions, and their movements during the ejection/insertion operation are normally controlled by a sequence programming means. A practical form of such a programming means comprises a set of cam plates 152 (FIG. 7, only one cam plate visible) rotatable in unison about a common axis and coupled by suitable cam following lever systems to respective operating elements. The cam plate set functions simultaneously as a programming means and as a source of drive motion for the operating elements. The latter are represented in FIG. 7 by the bobbin inserting arm 32, a package ejection lever 154, a cradle operating lever 156 and a yarn manipulating lever 158. Each of the levers 154, 156 and 158 is pivotally mounted at one end in the tender structure (not shown) and its movements on its pivot mounting are controlled and effected by the set of cams 152.

In the system to be described, it is not necessary to provide a specific "termination" programme for operating only the package ejection functions without the bobbin insertion functions. All of the operating levers perform their normal ejection/insertion movements even upon winding termination. Insertion of a bobbin is prevented by preventing feed of a bobbin to the bobbin holder, for example, by means of an arrangement as shown in FIG. 7.

FIG. 7 again shows the L-member 116 and retainer 118, but the body 110 has been modified in relation to the simple version shown in FIG. 6. Body 110 now includes side plates 111 which extend downwardly to or below the bobbin collection position. One side plate is assumed to be removed in the illustration of FIG. 7, so that the bobbin holder is visible.

Each leg structure 112, 114 (FIG. 6) is now secured to a respective side plate 111. In the illustrated version this is effected for the L-member by means of lugs 117 on the L-member and securing holes in the respective side plate. The appropriate securing holes are selected from an array of such holes 119 in dependence upon the required position of the L-member relative to the retainer 118, the pivot 120 of which is fixed to the same side plate. When the bobbin type is changed, the L-member can be released from its current securing holes and shifted to newly selected holes or replaced by a different size L-member held at newly selected holes.

Above the bobbin holder is a bobbin magazine in the form of an inclined plane 160 carrying a row of cylindrical bobbins 22. A wall 162 extends downwardly from plane 160 to pivot mounting 120. Wall 162 is fixed relative to the side plates 111 and forms the front of a feed chute directing bobbins from the plane 160 towards the holder. The back of the chute is provided by a wall 163 releasably secured to the plates 111 (for example, as described for L-member 116) and adjustable to adjust the size of the feed chute in dependence upon bobbin size. An upward extension of wall 163 forms a stop for the row of bobbins on plane 160.

Movement of individual bobbins along the chute is controlled by a selector gate comprising a U-shaped body 164 pivotally mounted at 166, so that either the one or the other arm of the U projects into the chute. Body 164 is biased by means not shown in a clockwise direction (as viewed in FIG. 7) on its mounting 166, so that the lower arm of the U projects into the chute and retains a column of bobbins above itself. When the selector 164 is pivoted anti-clockwise (as viewed in FIG. 7) against the bias, the lower arm of the U is retracted so that the lowermost bobbin of the column is released and is permitted to pass into the holder 110. The upper arm of the U is, however, inserted between the released bobbin and the next bobbin in the column, so that the remainder of the column is retained. When the selector is permitted to return to its normal (illustrated) position, the column is permitted to fall onto the lower arm of the U, so that the system is ready for a repeat operation.

Pivotal movement of body 164 on mounting 166 is effected by any suitable drive means (not shown) controlled by an electronic programmable controller PC. This controller PC also controls the drive for the set of cams 152. Controller PC initiates operation of the cam set both during a normal ejection/insertion operation and during a termination operation. However, controller PC only operates the selector gate to feed a bobbin to holder 110 if PC receives an input signal during a doffing operation indicating normal ejection/insertion. If a termination operation is signalled, the selector gate is not operated and holder 110 remains empty. This has the additional advantage that holder 110 remains empty during each return swing of the arm 32, so that gripper 30 can pass freely between leg structures 112, 114 on each return swing.

The detectors 168 and 170 respectively are provided to sense the "level of fill" of the magazine. Detectors 168, 170 are desirably light barriers adapted to beam across the row of bobbins, but any other detectors sensitive to the presence of bobbins can be substituted. The detector 168 is associated with the gate means. In operation, the gate can be maintained full in readiness for a feeding operation. If detector 168 senses that no bobbin is received by the member 164 when pivoted to its normal position, the detector sends a signal to controller PC which thereupon blocks further ejection/insertion operations and causes the service tender to travel to a loading position (not shown) at which further bobbins can be loaded into the magazine. Detector 170 functions similarly to detect the "full" condition of the magazine, controller PC duly responding to terminate the loading operation. Signals from the controller to the loading station can be transmitted via a cable connecting the tender to the machine, and thus to the loading station.

CONICAL/CYLINDRICAL BOBBINS

For ease of description, the previously illustrated embodiments have assumed that the machine is producing cylindrical packages so that the tender is handling cylindrical bobbins. This is not essential to the invention. The principles already explained are equally applicable where the machine is producing conical packages so that the tender is required to handle conical bobbins.

In design of some types of yarn handling machines, e.g. for open end spinning machines, it is now current practice to design the wind-up section to be adjustable to enable the machine to produce selectively either cylindrical or conical packages.

By whichever system the machine is adapted to produce alternatively cylindrical and conical packages, the service tender can be correspondingly adapted. This will be illustrated by reference to FIG. 8 showing the organisation of a multi-purpose service tender for use with a rotor spinning machine.

The rotor spinning machines (not shown) are of the type shown, for example, in U.S. Patent Specification No. 3,375,649. Each spinning station comprises a spinning unit, a yarn forwarding section for withdrawing yarn from the spinning unit and a wind-up section for forming the withdrawn yarn into a package. The wind-up section is located above the spinning unit.

The tender has a main framework 178, horizontally divided at line 177 into an upper suspension/drive section above line 177 and a depending section which contains the operating elements. Section 177 runs on a rail (not shown) to move the depending section past the spinning stations. The framework is vertically divided by bulkheads 179 into three portions. The operating elements are contained in the central portion, drives therefor are provided in one of the side portions and other "utilities" (e.g. suction systems, electronic controls) are provided in the other side portion.

The tender is assumed to be of the multi-purpose type designed to perform both piecing and doffing functions on the spinning stations. At least some of the function elements designed to operate on the wind-up sections of the stations are carried by sub-frame 180, function elements designed to operate between the wind-up sections and the spinning units are carried by a sub-frame 181 and function elements designed to co-operate directly with the spinning units are carried by a sub-frame 183.

Sub-frame 180 is pivotable in the main framework and is located in the full-line position for winding of cylindrical packages. For winding of conical packages, the sub-framework is tilted about an axis 182 into the dotted-line position 180A. When the tender is located in registry with an operating station, the axis 182 is coaxial with the pivot axis of the pivot mounting at which the wind-up section of the operating station is adjusted to enable it to wind conical packages. In the case of of the system shown in British Patent Specification No. 1344226, axis 182 is co-axial with the horizontal adjustment axis tangential to the friction drive roll.

The angle through which sub-frame 180 is adjusted corresponds, to half the cone angle of the conical package/conical bobbin, enabling the conical bobbin to engage the horizontal friction roller along the full length of the bobbin.

The sub-frame 180 carries those operating elements of the service tender which co-operate with the adjustable wind-up section of the machine; and which must be adjusted in order to deal with conical bobbins and packages. Where the service tender is of the multi-purpose type, being designed to perform both yarn piecing and package doffing operations, then sub-frame 180 may also carry operating elements used in the piecing operation; e.g. a package rotating roller carried by the tender and extendable therefrom into contact with the package to rotate the latter in the reverse direction to provide a "seed" yarn for piecing in an open end spinning machine.

MAGAZINE FOR CONICAL BOBBINS

The magazine shown in FIG. 7 must also be adapted if the tender is to be used with a machine producing conical packages, since conical bobbins will not roll satisfactorily down the inclined plane 160 suitable for cylindrical bobbins. FIG. 9 shows a drum-type magazine which can be substituted for the magazine of FIG. 7, the feed chute and the holder 110 remaining substantially the same. Drum-type magazines are not as such novel—see for example Japanese Published Patent Specification No. 47-25811. Such magazines present, however, a number of problems regarding control of bobbin movements into and out of the magazine, and the illustrated system shows elegant solutions to these problems.

The outer shell 184 of the magazine is cylindrical and is fixed relative to the chute, having an opening 186 in alignment with the chute. A gate means 187 similar to the gate shown in FIG. 7 is located adjacent the junction between the chute and shell 184. Gate 187 is normally biased into the illustrated disposition in which it retains a first bobbin while a second bobbin rests on the first.

Co-axial with shell 184 is a rotary member 188 carrying a plurality of bobbin receiving elements 190 at its periphery. Each element 190 is U-shaped in section, with the open side of the U facing radially outwardly towards the shell 184. The elements 190 are so located relative to shell 184 that a bobbin of predetermined size can be neatly received in the compartment defined between one element 190 and the shell. Member 188 is rotated about the axis of shell 184 by any suitable stepping drive means (not shown). The stepping drive means locates elements 190 successively in alignment with opening 186.

When gate 187 is operated to release the bobbin retained therein, the upper arm on the gate prevents the second bobbin falling until the gate returns to its normal disposition to retain the new bobbin. The stepping drive is then operated to align another element 190 with the opening 186. Assuming the newly arrived element 190 carries a bobbin, the latter falls into the chute to rest on the bobbin currently held by the gate mechanism.

Assume that member 188 is rotated in the direction of the arrow A in order to bring the compartments successively into alignment with opening 186 in order to feed bobbins to the holder 110. A bobbin detector 192, e.g. a light barrier type of detector, is located in association with the compartment next to the opening 186 considered in the direction of rotation indicated by arrow A. As before, a bobbin detector 194 is associated with the gate 187, and the gate is normally maintained full so that a "bobbin absent" signal from detector 194 indicates that the magazine is empty. The signal is passed to controller PC (FIG. 8) which causes the tender to move to a magazine loading position at one end of the machine. Additionally, each time the tender arrives at the one end of the machine and a "bobbin absent" signal is being produced by detector 192, the controller PC (which receives signals indicating arrival at the machine end) causes the tender to move to the magazine loading position even if the magazine is still part full, i.e. even if a "bobbin present" signal is received from detector 194. Thus the magazine is "topped up" each time the tender moves to the machine end.

An indexing mechanism is preferably provided to ensure that at the end of each rotation step one of the compartments is accurately aligned with the opening 186. A suitable arrangement is illustrated in dotted lines in FIG. 9. As shown, member 188 is associated with a rotary plate 196 having a plurality of recesses corresponding respectively with the elements 190. A spring bias roller 198 secured (by means not shown) to the tender frame, engages successively in the recesses of plate 196 as the latter rotates with member 188 thus locating the member in successive positions determined by the co-operation of the roller and the recesses. A detector 200 responsive to a predetermined part of the member 188, e.g. the adjoining region between two successive elements 190, can be provided to indicate rotary alignment/misalignment of the member 188, and the controller PC can respond in accordance with a predetermined programme when a misalignment is indicated.

The drum-type magazine could, of course, be used with cylindrical bobbins. However, the much simpler form of magazine illustrated in FIG. 7 is preferred wherever possible. The non-illustrated stepping mechanism could, for example, comprise a piston and cylinder unit adapted to pivot a pawl-like element co-operable with the indexing member 196. There may be two such piston and cylinder units, each with its respective pawl element for driving member 188 in the directions of arrows A and B respectively. Any alternative stepping mechanism could, of course, be used instead. The end faces of the drum may be closed except where an opening is left to enable loading of bobbins into a compartment aligned with the detector 192. This latter opening may be normally closable, but full closure of the end faces may in any event prove unnecessary since the bobbins are not normally subjected to any axial movement when located in their compartments.

FIGS. 10 and 11 show some further detail of a practical form of chute and gate mechanism designed specifically for conical bobbins, although modifications will readily be apparent to enable the use of the system with cylindrical bobbins. As best seen in FIG. 11, the chute is made up of two sheet metal portions 202, 204 respectively. These portions define a space 206 the cross section of which corresponds with the shape of the bobbins 208 to be controlled.

The gate pivoting mechanism is provided in part by a circular section rod 210, which is rotatable (by means not shown) about its own longitudinal axis. Secured to rod 210 at intervals spaced therealong are two cross pieces 212, 214 respectively (see FIG. 11). As illustrated in FIG. 10 for the cross piece 212, each cross piece carries a pair of arms 216, 218 respectively projecting from respective free ends of the cross piece. The arms 218 are joined by a bobbin engaging bar 220 (FIG. 11), and the arms 216 are joined by a similar bar (not seen in the figures). As shown in FIG. 11, the arms on cross piece 212 are slightly longer than the arms on cross piece 214 in order to allow for the shape of the bobbin.

Arms 218 normally project into the space 206 so that bar 220 underlies a bobbin 208 and prevents it moving down the feed chute under gravity. Arms 216 are normally withdrawn from the space 206.

When rod 210 is rotated anti-clockwise (as viewed in FIG. 10) arms 216 are moved into the space 206, and arms 218 are withdrawn. Retraction of the bar 220 from beneath bobbin 208 releases that bobbin and permits it to fall down the chute under gravity until it comes to rest in the holder 110. The bar carried by arms 216 is inserted into the wedge-shaped gap between the released bobbin and the next one, so that the latter is prevented from following the released bobbin. After the released bobbin has cleared the gate mechanism, rod 210 is pivoted back to its previous position.

Arms 216 are now withdrawn from the chute so that the next bobbin falls into contact with the bar 220 and the system is now ready for a repeat operation.

COMPLETE DOFFING OPERATION

A complete package ejection/bobbin insertion sequence, and a complete set of equipment appropriate thereto, will vary substantially depending upon both the machine-type and the detailed design thereof. Purely by way of example, for the sake of completeness of the present specification, a complete set of equipment suitable for operating upon a specific design of open end spinning machine will be listed and very briefly described in the following.

It is assumed that the open end spinning machine is of the type in which package winding is stopped when the package has reached a predetermined length, and the cradle mechanism is operated to lift the fully-wound package through a short distance away from the friction drive roll 10. In this "lifted-off position", the package awaits the arrival of the service tender.

After being located in registry with the spinning station, the tender first operates a "cradle lift" lever which engages the arm 16 of the cradle mechanism and lifts it to its uppermost position. As already described, the cradle will be maintained in this position by the cradle mechanism of the machine. The tender then moves out a "doffing lever" which engages the underside of the package to support it. Further, the tender moves out an "upper cradle opener" which opens the cradle as described with reference to FIG. 2 in order to release the package, which is thereupon moved away from the cradle mechanism by the doff lever to a position at which the package is taken over by transport means on the machine. The doff lever is then withdrawn and the bobbin insertion arm is operated to bring a bobbin to the transfer location as described with reference to FIGS. 1 and 3. The upper cradle opener is then operated to close the cradle; this opener also exerts a grip on the lever 16 and, after closing of the cradle, forces the cradle downwardly, initially against the action of the cradle mechanism.

When the cradle has passed over the dead point of the over-centre mechanism, the upper cradle opener releases its grip on the cradle, and control of lowering of the cradle to the winding position is taken over by the cradle lift lever.

When the bobbin has been brought to the winding position, the cradle lift lever is withdrawn and the thread reserve device (FIG. 2) is moved to its initial position. A "lower cradle opener" (44, FIG. 2) is now operated to re-open the cradle, the bobbin being held in position by the gripper 30, as already described with reference to FIG. 2. The thread manipulating device 48, with its attached knife edge 52, is then moved to bring the yarn into a position ready for clamping. The further operations have already been fully described.

The expressions "cradle" and "cradle mechanism" as used in both the description and claims are not limited to a package holding device comprising a pair of arms. Alternative systems are known. In one alternative, the bobbin is held upon a "chuck" member carried by a single arm swingable to produce the arc of movement 40 shown in FIG. 1. The chuck is mounted cantilever fashion on the arm, for example as shown in U.S. Specification No. 3,491,961. In the preferred arrangement, however, the package/bobbin is held by clamping pressure applied to its ends; any convenient means may be used for this purpose. The terms "bobbin" and "bobbin tube" used herein are intended to be synonymous. The term "doffing" as used herein refers to an operating sequence including both package ejection and fresh bobbin insertion.

The terms "cradle means" and "cradle mechanism" used herein are synonymous.

I claim:

1. In a yarn handling machine, the combination comprising a bobbin gripper movable along a first fixed path of movement for selectively gripping bobbins of varying diameter, said gripper including a plurality of adjustably mounted bobbin engaging elements for gripping a selected bobbin;

a bobbin holder for presenting a selected bobbin to said gripper at a predetermined bobbin collection location on said path, said holder including an adjustable element selectively mounted in each of a plurality of positions corresponding to bobbins of varying diameter to receive a bobbin of a diameter corresponding to said selected position with an axis of each received bobbin of varying diameter located on said path, and a retainer element for retaining a received bobbin on said adjustable element;

a cradle mechanism having a pair of parallel arms movable along a second path of movement to receive a bobbin between said arms from said gripper at a predetermined transfer location common to said paths and to move the bobbin to a yarn winding position.

2. The combination as set forth in claim 1 wherein said retainer element releaseably retains the received bobbin on said adjustable element.

3. The combination as set forth in claim 1 which further comprises a carrier member for moving said gripper along said first path.

4. The combination as set forth in claim 3 wherein each bobbin engaging element is replaceably mounted to adapt said gripper to bobbins of varying diameter.

5. A service tender for a yarn handling machine, said tender including a bobbin holder for individually presenting a plurality of bobbins of varying diameter at a predetermined location, said holder including an adjustable element selectively mounted in each of a plurality of positions corresponding to bobbins of varying diamter to receive a bobbin of a diameter corresponding to said selected position with an axis of each received bobbin of varying diameter located on a predetermined path and a retainer element for retaining a received bobbin said adjustable element, and a bobbin gripper movable along said path to receive a selected bobbin from said bobbin holder at said predetermined location and to transfer the received bobbin to a cradle mechanism of an operating station at a transfer location thereof, said gripper including a plurality of adjustably mounted bobbin engaging elements for selectively gripping bobbins of varying diameter, each said element being replaceably mounted to adapt said gripper to bobbins of varying diameter.

6. A service tender as set forth in claim 5 which further comprises a bobbin magazine on said service tender for delivering individual bobbins to said bobbin holder.

7. A service tender as set forth in claim 5 which further comprises a carrier member for moving said gripper along said path.

8. In a yarn hadnling machine, the combination comprising a bobbin gripper movable along a first fixed path of movement, said gripper including at least one adjustably mounted bobbin engaging element for locating the axis of a received bobbin of a plurality of bobbins of varying diameter on said fixed path;

a bobbin holder for individually presenting bobbins of varying diameter to said gripper at a common bobbin collection location on said fixed path, said holder including an adjustable element selectively mounted in each of a plurality of positions corresponding to bobbins of varying diameter to receive a bobbin of a diameter corresponding to said selected position with an axis of each received bobbin of varying diameter located on said fixed path and a retainer element for retaining a received bobbin on said adjustable element; and a cradle mechanism movable along a second fixed path of movement to receive a bobbin from said gripper at a predetermined transfer location common to said paths and to move the bobbin to a yarn winding position.

9. The combination as set forth in claim 8 wherein said gripper is movable relative to said holder at said bobbin collection station.

10. The combination as set forth in claim 8 wherein said first fixed path defines a circular arc.

11. The combination as set forth in claim 8 wherein said gripper releaseably retains a bobbin.

* * * * *

UNITED STATES PATENT AND TRADEMARK OFFICE

CERTIFICATE OF CORRECTION

PATENT NO. : 4,598,881

DATED : July 8, 1986

INVENTOR(S) : Andre Lattion

It is certified that error appears in the above-identified patent and that said Letters Patent is hereby corrected as shown below:

Column 3, line 23 "magnazine" should be -magazine-
Column 3, line 64 "is" should be -in-
Column 4, line 21 "so to" should be -so as to-
Column 5, line 42 "di position" should be -disposition-
Column 7, line 1 "in description" should be in-in the description-
Column 8, line 3 cancel "in the form of"
Column 8, line 4 after "end" insert -a bobbin engaging element in the form of-
Column 8, line 16-17 cancel "in the form of"
Column 9, line 19 "is, illustrated" should be -is illustrated-
Column 9, line 29 "relative" should be -relatively-
Column 12, line 37 "of of" should be -of-
Column 12, line 42 "corresponds, to" should be -corresponds to
Column 16, line 65 "hadnling" should be -handling-

Signed and Sealed this

Twentieth Day of January, 1987

*Attest:*

DONALD J. QUIGG

*Attesting Officer*

*Commissioner of Patents and Trademarks*